US006105404A

United States Patent [19]

Field et al.

[11] Patent Number: 6,105,404

[45] Date of Patent: Aug. 22, 2000

[54] SQUIGGLE KEYS AND CYLINDER LOCKS FOR SQUIGGLE KEYS

[75] Inventors: Peter W. Field, Salem; Andrew E. Perkins, Lafayette, both of Va.

[73] Assignee: Medeco Security Locks, Inc., Salem, Va.

[21] Appl. No.: 09/107,403

[22] Filed: Jun. 30, 1998

[51] Int. Cl.[7] ..... E05B 27/00

[52] U.S. Cl. ..... 70/365; 70/358; 70/493; 70/406; 70/409

[58] Field of Search ..... 70/365–367, 369, 70/376, 377, 356, 357, 347, 348, 490, 358, 409, 493, 406

[56] References Cited

U.S. PATENT DOCUMENTS

| | | | |
|---|---|---|---|
| 179,887 | 7/1876 | Arnold . | |
| 1,328,074 | 1/1920 | Bennett . | |
| 1,456,584 | 5/1923 | Bell . | |
| 1,589,256 | 6/1926 | Spruth . | |
| 1,600,661 | 9/1926 | Winning . | |
| 1,616,255 | 2/1927 | Douglas . | |
| 1,979,186 | 10/1934 | Biemer . | |
| 2,023,207 | 12/1935 | Olson . | |
| 2,023,208 | 12/1935 | Olson . | |
| 2,023,847 | 12/1935 | Liss | 70/365 |
| 2,030,836 | 2/1936 | Full et al. . | |
| 2,030,837 | 2/1936 | Full et al. . | |
| 2,035,181 | 3/1936 | Molinare . | |
| 2,039,126 | 4/1936 | Svoboda . | |
| 2,073,583 | 9/1937 | Olson . | |
| 2,079,628 | 5/1937 | Olson . | |
| 2,155,440 | 4/1939 | Olson . | |
| 2,155,734 | 4/1939 | Olson . | |
| 2,375,682 | 5/1945 | Olson . | |
| 2,687,639 | 8/1954 | Swanson . | |
| 2,829,513 | 4/1958 | Fresard et al. . | |
| 3,035,433 | 5/1962 | Testa . | |
| 3,137,156 | 6/1964 | Navarro . | |
| 3,263,461 | 8/1966 | Tartaglia . | |
| 3,264,852 | 8/1966 | Gysin . | |
| 3,349,587 | 10/1967 | Keller . | |
| 3,509,749 | 5/1970 | Regan et al. . | |
| 3,570,287 | 3/1971 | Hallmann | 70/365 |
| 3,581,534 | 6/1971 | Testa | 70/383 |
| 3,754,422 | 8/1973 | Stackhouse | 70/377 |
| 3,935,720 | 2/1976 | Boving | 70/365 |
| 4,067,214 | 1/1978 | Kiraly | 70/366 |
| 4,098,104 | 7/1978 | Wolter | 70/406 |
| 4,142,389 | 3/1979 | Bahry et al. | 70/359 |
| 4,270,372 | 6/1981 | Vonlanthen et al. | 70/406 |
| 4,977,767 | 12/1990 | Prunbauer | 70/406 |
| 5,123,268 | 6/1992 | Eizen | 70/359 |
| 5,189,895 | 3/1993 | Schwab et al. | 70/366 |

FOREIGN PATENT DOCUMENTS

| | | | |
|---|---|---|---|
| 392317B | 3/1991 | Austria . | |
| 0144481 | 6/1985 | European Pat. Off. . | |
| 428029A | 5/1991 | European Pat. Off. . | |
| 2425523 | 12/1979 | France . | |
| 6603858 | 11/1969 | Germany . | |
| 2905942 | 9/1979 | Germany | 70/365 |
| 3005481 | 6/1980 | Germany | 70/366 |
| 2266918 | 11/1993 | United Kingdom . | |

OTHER PUBLICATIONS

International Search Report.

*Primary Examiner*—Suzanne Dino Barrett
*Attorney, Agent, or Firm*—Rothwell, Figg, Ernst & Manbeck

[57] ABSTRACT

Improved squiggle keys and cylinder locks include a squiggle key groove formed along a first broad surface of the squiggle key and a plurality of bittings formed along a second opposite broad surface of the squiggle key. The cylinder lock includes a plurality of rotatable discs that have groove-following elements that are rotated via the groove on the key. The rotatable discs operate to prevent a plug of the cylinder lock from rotating unless a correct squiggle key is inserted into a keyway in the plug. The bittings formed along the second opposite broad surface of the squiggle key are generally circular and have inner regions with a different depth than outer regions of the bittings. As a result, tumbler pins can be located along the inner and/or outer regions of the bittings which enables increased keying capabilities and variations and which enables a common lock to be operated by keys for different cylinder locks.

26 Claims, 10 Drawing Sheets

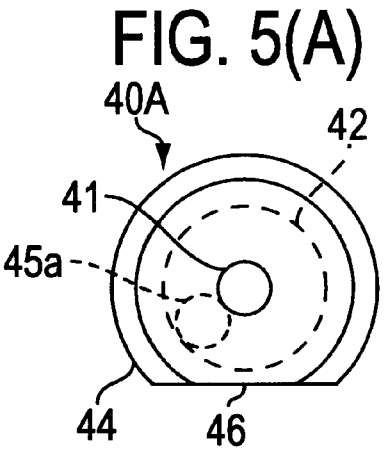
FIG. 5(A)
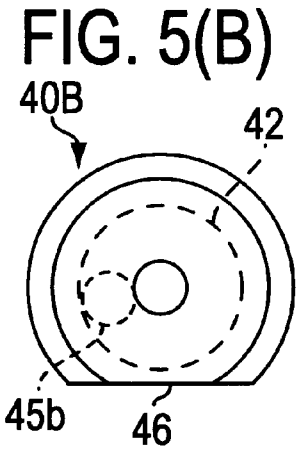
FIG. 5(B)
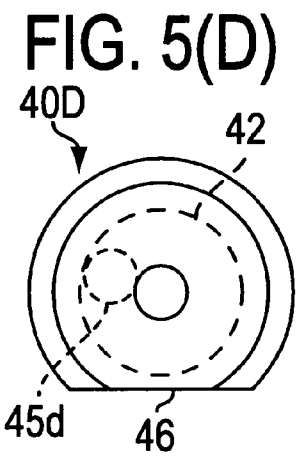
FIG. 5(C)
FIG. 5(D)
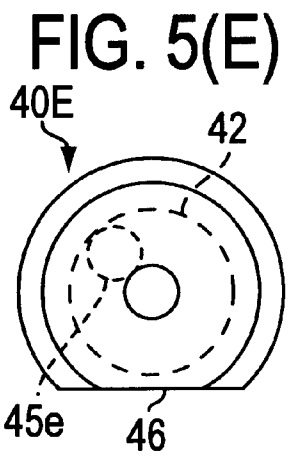
FIG. 5(E)

SQUIGGLE KEYS AND CYLINDER LOCKS FOR SQUIGGLE KEYS

BACKGROUND OF THE INVENTION

1. Field of the Invention:

The present invention relates generally to squiggle keys and to cylinder locks operated by such squiggle keys.

2. Background of the Invention:

A variety of squiggle keys and locks operated by such squiggle keys are known in the art.

The terminology squiggle key is used herein to refer to keys having a key blade with at least one groove (i.e., camming surface) extending generally lengthwise along at least one side thereof. When the squiggle key is inserted into its corresponding lock, the groove receives a groove-following element of the lock and moves the groove-following element to a lock-opening position once the key is fully inserted into the lock.

The following United States Patents illustrate known squiggle keys and locks and show the nature of the prior art developed over the last century: No. 179,887 (Arnold); No. 1,328,074 (Bennett); No. 1,456,584 (Bell); No. 1,589,256 (Spruth); No. 1,600,661 (Winning); No. 1,616,255 (Douglas); No. 1,979,186 (Biemer); No. 2,023,207 (Olson); No. 2,023,208 (Olson); No. 2,030,836 (Full et al.); No. 2,030,837 (Full et al.); No. 2,035,181 (Molinare); No. 2,039,126 (Svoboda); No. 2,073,583 (Olson); No. 2,070,628 (Olson); No. 2,155,440 (Olson); No. 2,155,734 (Olson); No. 2,375,682 (Olson); No. 2,687,639 (Swanson); No. 2,829,513 (Fresard et al.); No. 3,035,433 (Testa); No. 3,137,156 (Navarro); No. 3,263,461 (Tartaglia); No. 3,264,852 (Gysin); No. 3,509,749 (Regan et al.); No. 3,581,534 (Testa); No. 3,754,422 (Stackhouse); No. 4,067,214 (Kiraly); No. 4,270,373 (Vonlanthen et al.); and No. 4,977,767 (Prunbauer).

Although a variety of squiggle keys and cylinder locks for such squiggle keys are known, there still remains a need for improved squiggle keys and improved cylinder locks for such squiggle keys.

SUMMARY OF THE INVENTION

The present invention overcomes problems related to existing squiggle keys and locks for such squiggle keys.

According to a first aspect of the invention, a key having a groove extending generally lengthwise along a side of the key is provided in combination with a cylinder lock including: a shell having a bore for receiving a rotatable plug; a rotatable plug located within the shell and having a keyway configured to receive the key; at least one rotatable disc within the plug, each rotatable disc having a groove-following element that fits within the groove of the key when the key is inserted into the keyway and which rotates the rotatable disc around an axis via the key; and wherein the rotatable disc initially extends outward from a circumference of the plug and engages the shell, the rotatable disc is movable via the key so that a portion of the rotatable disc moves inward toward the plug to disengage from the shell and to allow the plug to rotate when the key is fully inserted into the keyway. Preferably, the groove extends along a first broad side of the key, while a second broad side of the key opposite to the groove includes at least one bitting for receiving a tumbler pin, and the cylinder lock includes a tumbler pin bore within the plug on a side opposite to the rotatable disc, the tumbler pin bore having a tumbler pin located therein which is fittable within the bitting.

According to another aspect of the invention, a system of locks and keys is provided which includes: a) a first squiggle key having a groove extending generally lengthwise along a first broad side of the key and having a plurality of bittings along a second broad side of the key, the plurality of the bittings including inner regions and outer regions having different depths; b) a second squiggle key having a groove extending generally lengthwise along a first broad side of the second key and having a plurality of bittings along a second broad side of the second key, the plurality of the bittings including inner regions and outer regions having different depths; c) the first squiggle key operating a first lock but not operating a second lock, and the second squiggle key operating a second lock but not the first lock, wherein the first and second locks include tumbler pins that align with one of the inner and outer regions on both of the first and second squiggle keys; d) a common lock that is operated by both the first and second squiggle keys, the common lock having tumbler pins that align with the other of the inner and outer regions on both of the first and second squiggle keys.

According to another aspect of the invention, a key for a cylinder lock is provided that includes: a key bow; a key blade extending from the key bow, the key blade having a narrow width and broad first side and a broad second side opposite the broad first side; a groove extending generally lengthwise along the broad first side of the key blade; and the second broad side of the key blade having a plurality of bittings located along a common center-line generally parallel to a length of the key blade and configured to receive tumbler pins of a cylinder lock that are generally perpendicular to the second broad side. Preferably, the plurality of bittings include bittings having inner regions of a first depth and outer regions of a second depth, and, more preferably, the bittings having inner and outer regions are circular bittings.

According to another aspect of the invention, a key blank is provided that includes: a key bow; a key blade extending from the key bow, the key blade having a narrow width and broad first and second opposite sides; a groove extending generally lengthwise along the broad first side of the key blade; and the second broad side of the key blade including a region for receiving bittings therein. Preferably, the groove includes flat portions that are parallel to the key blade and that are flat at locations equidistantly spaced a predetermined distance along the key blade for cooperating with a lock having tumbler pins spaced the predetermined distance. In one embodiment, the flat portions are at least about 0.04 to 0.07 inches long. The second broad side can be completely flat or can be partly machined to include one or more grooves extending parallel to the length of the key blade.

Among other things, the preferred embodiments of the present invention provide a unique squiggle key structure that combines both a squiggle key groove on a first side of squiggle key and bittings for tumbler pins on a second side of the tumbler pins. Hithereto, no such combination of features has been contemplated in the prior art. The preferred embodiments of the present invention also provide a unique rotatable disc arrangement that is operated via the squiggle key groove and which provides increased security and inhibits tampering and picking of the lock. The preferred embodiments of the present invention also provide a unique multi-level bitting and squiggle key structure that easily enables a common lock to be accessed with different keys and that enables other keying variations.

The above and other advantages, features and aspects of the present invention will be more readily perceived from the following description of the preferred embodiments thereof taken together with the accompanying drawings and claims.

BRIEF DESCRIPTION OF THE DRAWINGS

The present invention will become more fully understood from the following detailed description and the accompanying drawings which are given by way of illustration and are not limitative of the present invention.

FIG. 5 is a schematic top view demonstrating rotating discs when a proper squiggle key is inserted into the cylinder lock such that flat sides of the rotating discs align with the circumference of the plug;

DETAILED DESCRIPTION OF THE PREFERRED EMBODIMENTS

As discussed below, the present invention includes a number of aspects that can be used either individually or together in combination with one another.

Figure 1A:
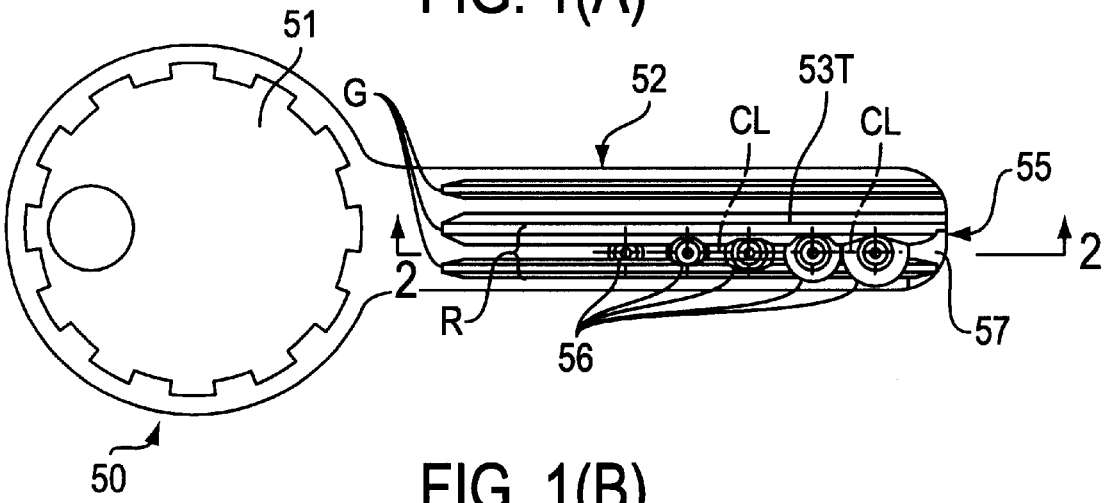
FIG. 1(A) is a side view of a first broad side of a key, with bittings therein, according to one embodiment of the invention.
Figure 1B:
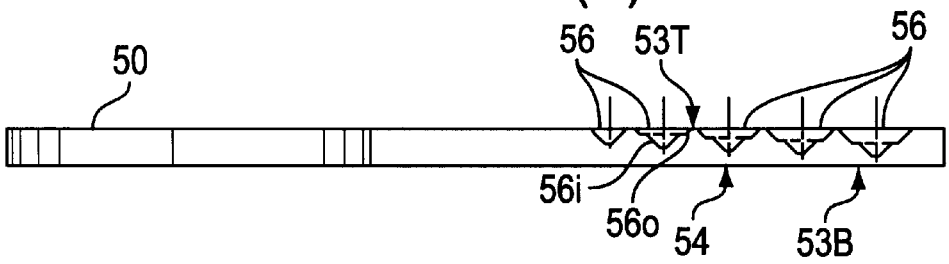
FIG. 1(B) is a side view of the key shown in FIG. 1(A) showing the bittings therein.
Figure 1C:
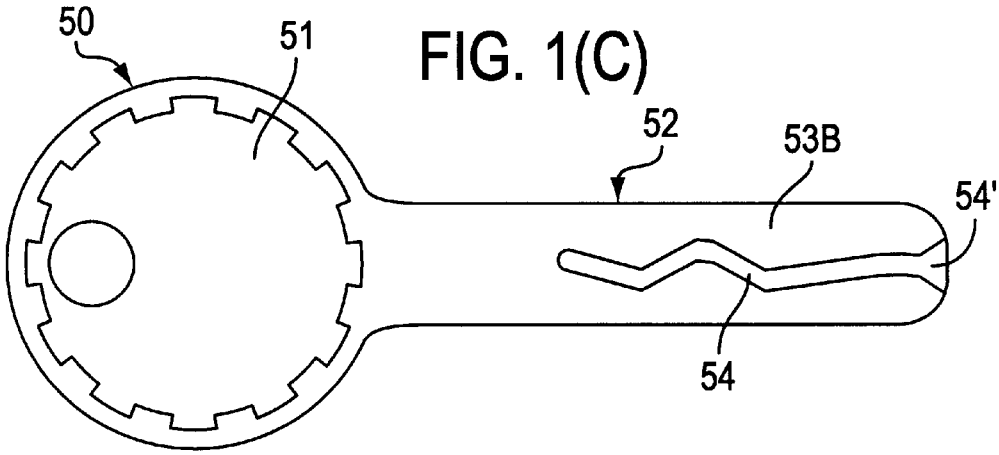
FIG. 1(C) is a side view of a second broad side of the key shown in FIG. 1(A), with a squiggle-key groove therein, according to one embodiment of the invention.

According to a first aspect of the invention, as shown in FIGS. 1(A) through 1(C), a squiggle key 50 having a key bow 51 and a key blade 52 is provided with at least one groove 54 extending generally lengthwise along the key blade 52. As shown in FIG. 1(C), a single groove 54 is preferably provided on a first broad side surface 53B of the key blade 52. As shown in FIG. 1(F), the groove 54 preferably has a depth d smaller than the width w of the key blade.

According to a second aspect of the invention, the squiggle key has a second broad side surface 53T having a region R configured to receive one or more bittings 56 along the length of the key blade 52.

Figure 4:
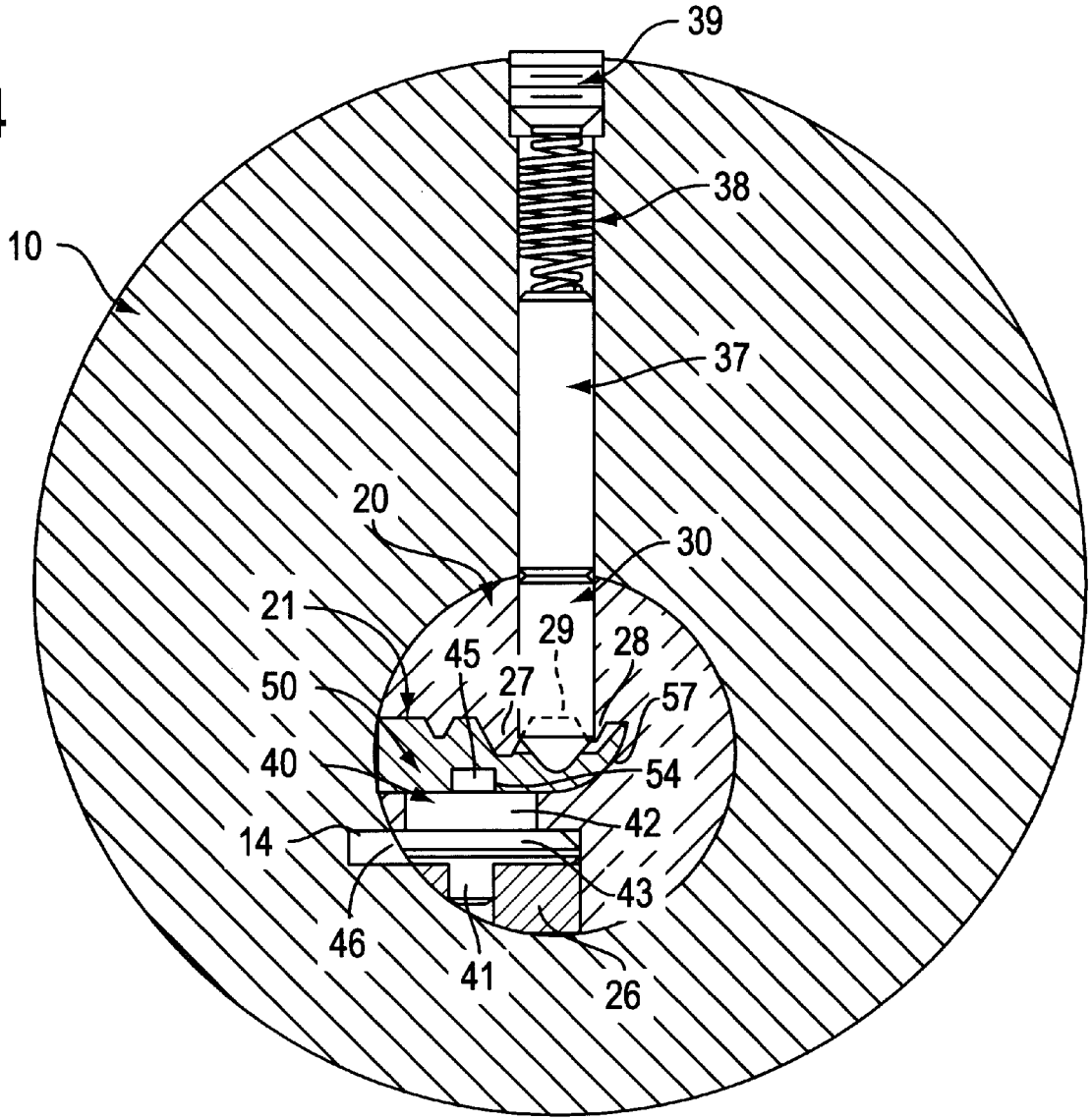
FIG. 4 shows a cross-sectional end view of the cylinder lock shown in FIG. 3 having a squiggle key similar to that shown in FIG. 1(A) inserted therein.

When both of the above aspects of the invention are incorporated into a single key, which is preferred, a unique key having a squiggle-key groove on a first broad side surface and tumbler pin bittings on a second opposite broad side surface is provided. As shown in FIG. 1(F), the tip 55 of the key blade 52 is preferably adapted to receive groove-following elements on the bottom surface 53B and tumbler pins on the top surface 53T. In this regard, the groove 54 preferably has a widened front entrance 54' that facilitates reception of groove-following elements, and the side 53T preferably has an inclined ramp 57 that guides tumbler pins onto the surface 53T. As shown in FIG. 1(F), the ramp 57 and the region 54' are preferably laterally displaced from one another (in the direction of the length L of the cross-section shown in FIG. 1(F)) to avoid weakening the key blade 52. Similarly, the groove 54 is preferably primarily located laterally to the side of a center-line axis CL extending through the bittings 56 to avoid weakening the key blade 52. As best shown in FIG. 4, the key blade 52 preferably has a generally rectangular cross-section, with one corner of the rectangular cross-section opposite to the bittings 56 preferably being made into a curved edge 57 along the length of the key blade in a manner as shown.

Squiggle Key Groove(s) and Cylinder Lock Structure Therefor

As discussed above, a first aspect of the present invention includes a squiggle key having a groove extending along its length and also includes an improved cylinder lock structure for such a squiggle key.

Figure 3:
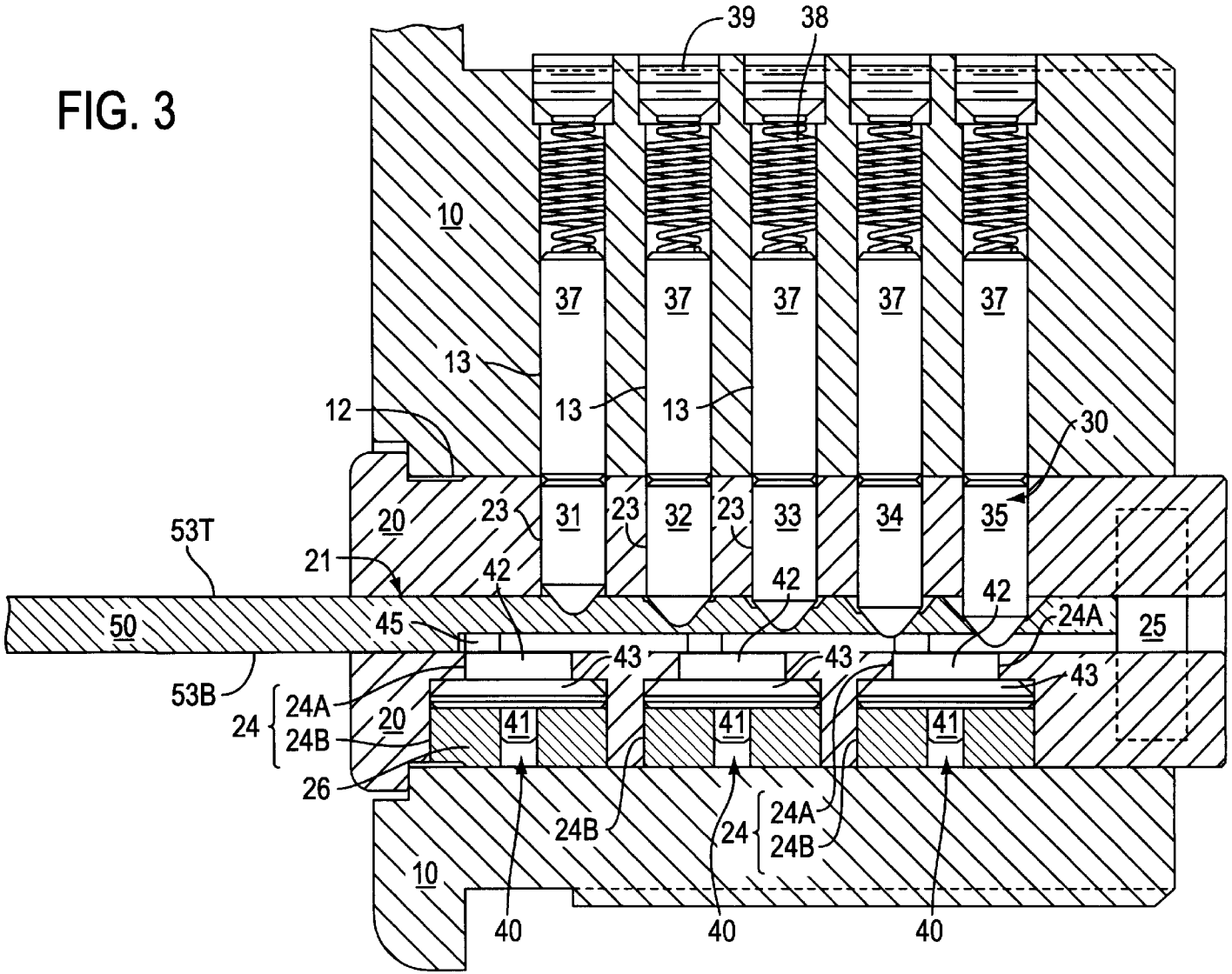
FIG. 3 shows a cross-sectional side view of a cylinder lock according to one embodiment of the invention having a squiggle key similar to that shown in FIG. 1(A) inserted therein.

As shown in FIG. 3, a cylinder lock is preferably provided with a shell 10 having a plug bore 12 and a rotatable plug 20 within the bore 12. The plug 20 includes a keyway 21 for receiving the key 50 and a plurality of disc-receiving-cylindrical bores 24 having narrow-upper portions 24A and wide-lower portions 24B. Each of the bores 24 houses a rotatable disc 40. Each of the rotatable discs 40 preferably includes a bottom pivot pin 41 on a central axis of the rotatable disc 40 and a key post 45 displaced from the central axis. The key posts 45 function as groove-following elements that ride along the groove 54 of the key 50. The rotatable discs 40 also include narrow-upper portions 42 and wide-lower portions that reside within the upper and lower portions 24A, 24B, respectively, of the bore 24.

In order to retain the discs 40 within the plug 20, disc spacers 26 are located within each of the wide portions 24B of the bore 24. The disc spacers 26 include central bores as shown that receive the pivot pins 41. The disc spacers 26 are preferably pressed, welded, screwed or otherwise mounted within the bores 24 so that the discs 40 are snugly retained while freely rotating about the common central axes of the upper portions 42 and the pins 41.

Figure 6:
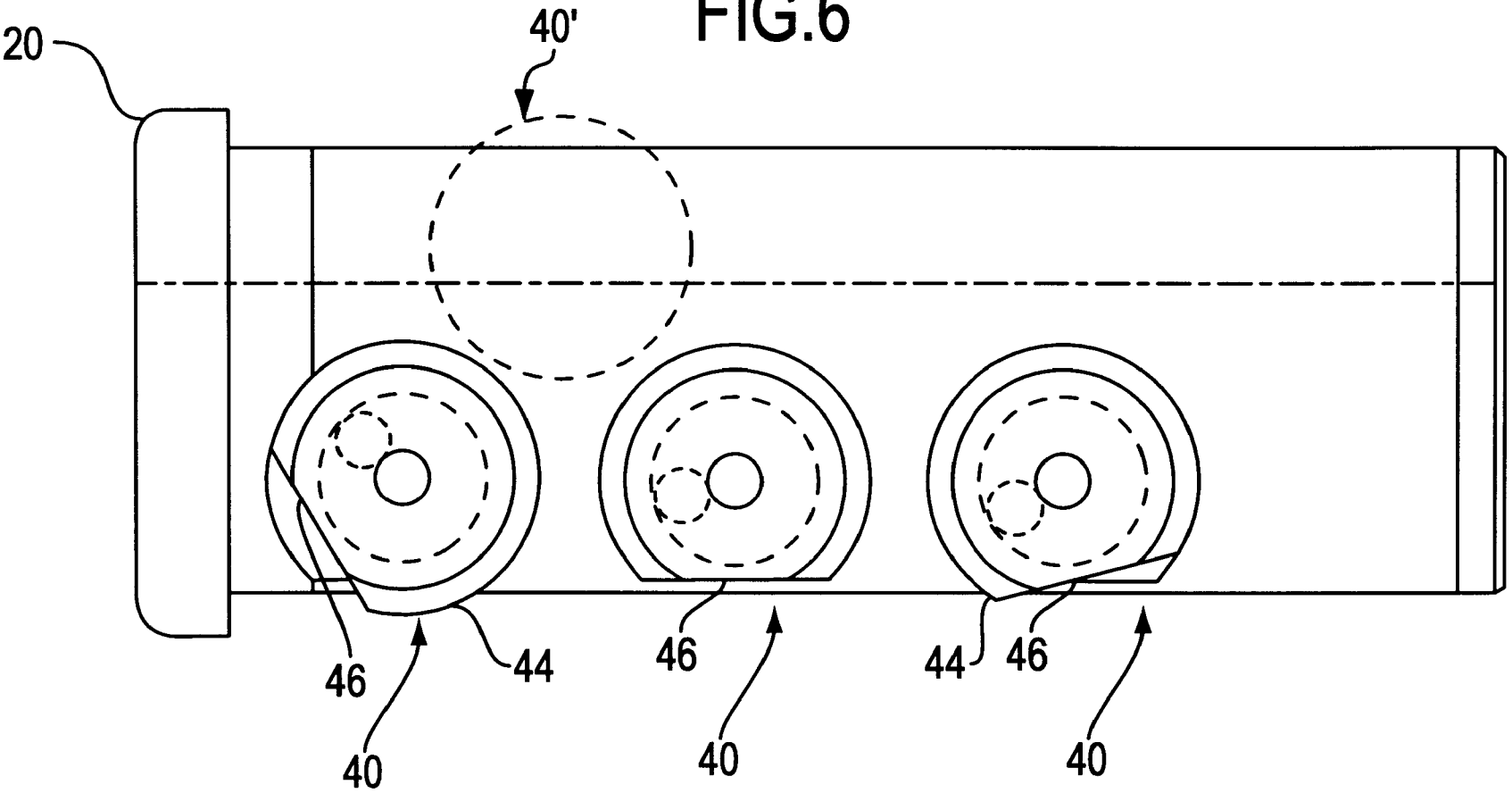
FIG. 6 shows the rotated discs with their flat sides misaligned with the circumference of the plug such that the plug cannot be rotated within the cylinder lock.

As shown in FIGS. 4–6, each of the wide portions 43 of the discs 40 includes an outer flange 44 that typically extends through side openings in the plug 20 and includes a flat side 46 configured to fit within the circumference of the plug 20 when rotated to an opening position (see, for example, FIGS. 4 and 5). As also shown in FIG. 4, the disc spacers 26 are preferably configured to remain within the circumference of the plug 20 and can include, for example, an outer curvature matching that of the plug 20 as shown.

In operation, as a user inserts a key 50 into the plug 20, the widened region 54' of the groove 54 receives the key post 45*a* of the first rotatable disc 40A. As the key 50 further enters into the plug, the disc 40A rotates due to the contour of the groove 54 and the groove 54 similarly receives the key posts of the remaining discs 40. The plug 20 can include one or more rotatable disc 40. In the exemplary embodiment shown in FIGS. 3, 4, 6 and 7, the plug 20 includes three rotatable discs. More or less discs can be used depending on circumstances. In this regard, FIG. 5 shows an another example having five rotatable discs.

Although a preferred disc structure is illustrated, it should be understood that the disc structure can be modified greatly without departing from the scope of the present invention depending on circumstances. For example, the discs do not necessarily need to be generally cylindrical, but can be triangular, square, hexagonal, rectangular, or even irregular in shape, as long as the discs are configured to rotate and to extend beyond the circumference of the plug when an incorrect key is inserted, but to allow rotation of the plug when a correct key is inserted.

When a key 50 has a groove 54 that is configured to position the discs 40 in their opening positions (see, for example, FIG. 5), upon full insertion of the key 50, the flat sides 46 of the discs are positioned to allow the plug 20 to be rotated to open the lock. A variety of groove shapes can be employed as long as the groove is configured to place the key posts 45 at their respective positions when the key is fully inserted into the lock. When a key having an incorrect groove 54 is inserted into the lock, the flange 44 of the wide portion 43 on one or more of the discs 40 extends laterally from the plug 20 and into the disc locking slot 14 shown in FIG. 4 to prevent rotation of the plug 20 within the bore 12 (see, e.g., FIG. 6).

As discussed above, the cylinder lock preferably includes rotatable discs 40 that operate in conjunction with tumbler pins (discussed in greater detail below). It is contemplated, however, that such tumbler pins can be omitted and that one or more rotatable disc can be used to lock the rotation of the plug 20 alone. It is also contemplated that the key 50 could be provided with grooves on both opposite broad sides of the key and that corresponding discs 40 could be provided both above and below the broad sides of the key. Further, although the discs 40 are shown to rotate about generally vertical axes, the discs could also be oriented to rotate around a non-vertical axis. When tumbler pins are used, however, the tumbler pins (as well as the discs) are preferably oriented generally vertically.

In another alternative, the key 50 could include two grooves extending along one (or both) of the broad sides of the key 50 and two rows of rotating discs could be located at that broad side of the key which extend from opposite sides of the plug 20; as shown in FIG. 6, for example, a second row of rotatable discs 40' (one disc shown) can be offset from a first row to conserve space. In yet another alternative, a groove could be provided along a narrow side of the key blade 52 and the key slot could be positioned to accommodate at least one rotatable disc that would rotate around an axis perpendicular to that narrow side of the key.

The rotatable discs 40 and related structure of the preferred embodiments of the present invention have significant advantages over existing squiggle key locking mechanisms. Squiggle key locking mechanisms typically include groove-following elements that are linearly moved via the groove rather than being rotated. The rotatable discs of the present invention can, among other things, increase the security of the lock and inhibit tampering and picking of the lock. The rotatable discs enable, for example, a greater relative movement of the outer blocking flanges of the rotatable discs. As a result, minor variations in the position of the key posts can provide a greater extension of the flanges, resulting in a secure, tamper-proof lock.

Squiggle Key Bittings and Cylinder Lock Structure Therefor

The second aspect of the invention includes bittings 56 on a second broad side of the key blade 52, as discussed above and as shown in FIGS. 1(A) and 1(B), and also includes an improved lock structure therefor.

Figure 2A:
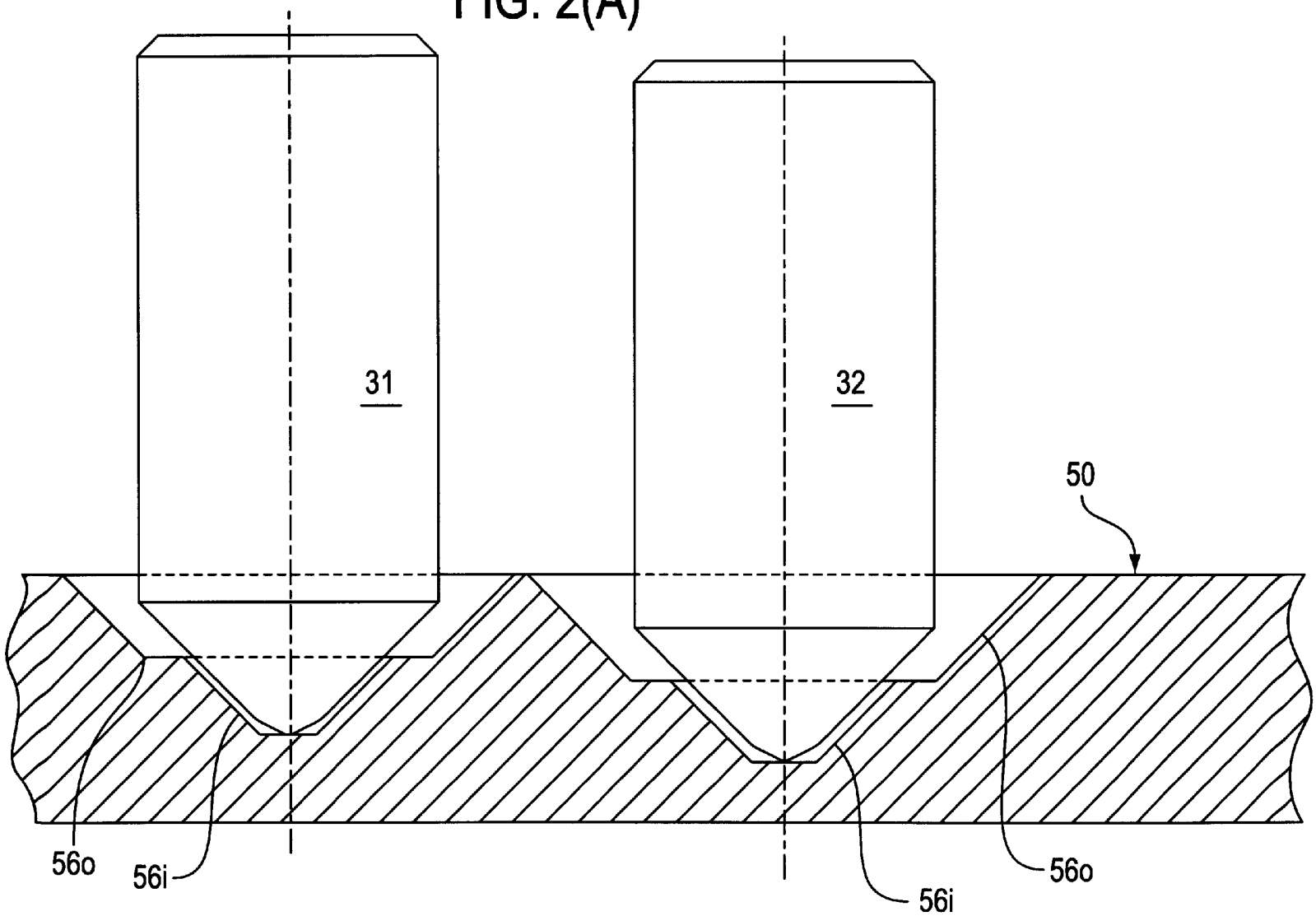
FIGS. 2(A) shows a cross-sectional view of a portion of the squiggle key shown in FIG. 1(A) taken along the axis 2—2 in FIG. 1(A) wherein tumbler pins of a cylinder lock are received within lower portions of the bittings.
Figure 2B:
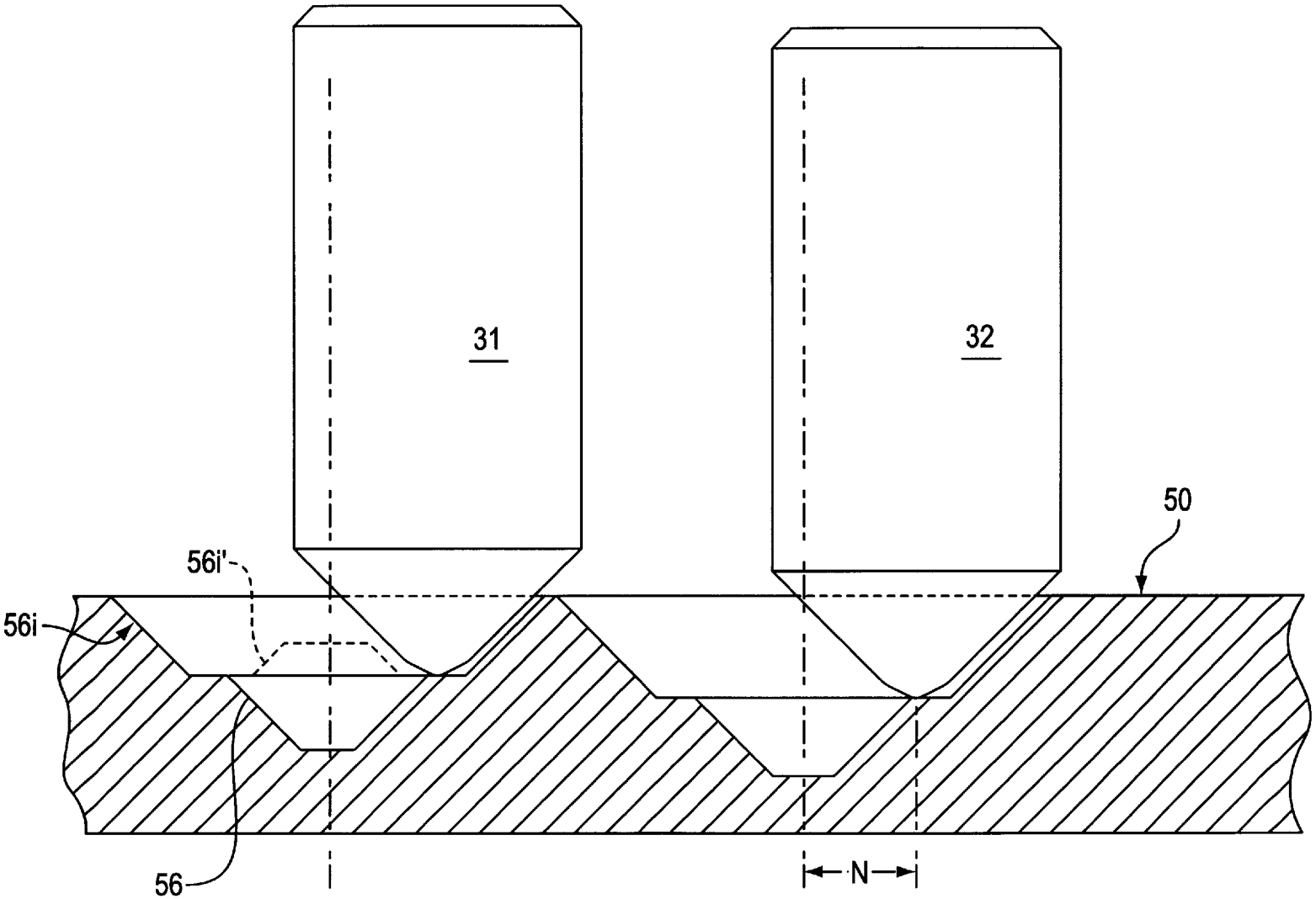
FIGS. 2(B) shows a cross-sectional view of a portion of the squiggle key shown in FIG. 1(A) taken along the axis 2—2 in FIG. 1(A) wherein tumbler pins of a cylinder lock are received within upper portions of the bittings.
Figure 2C:
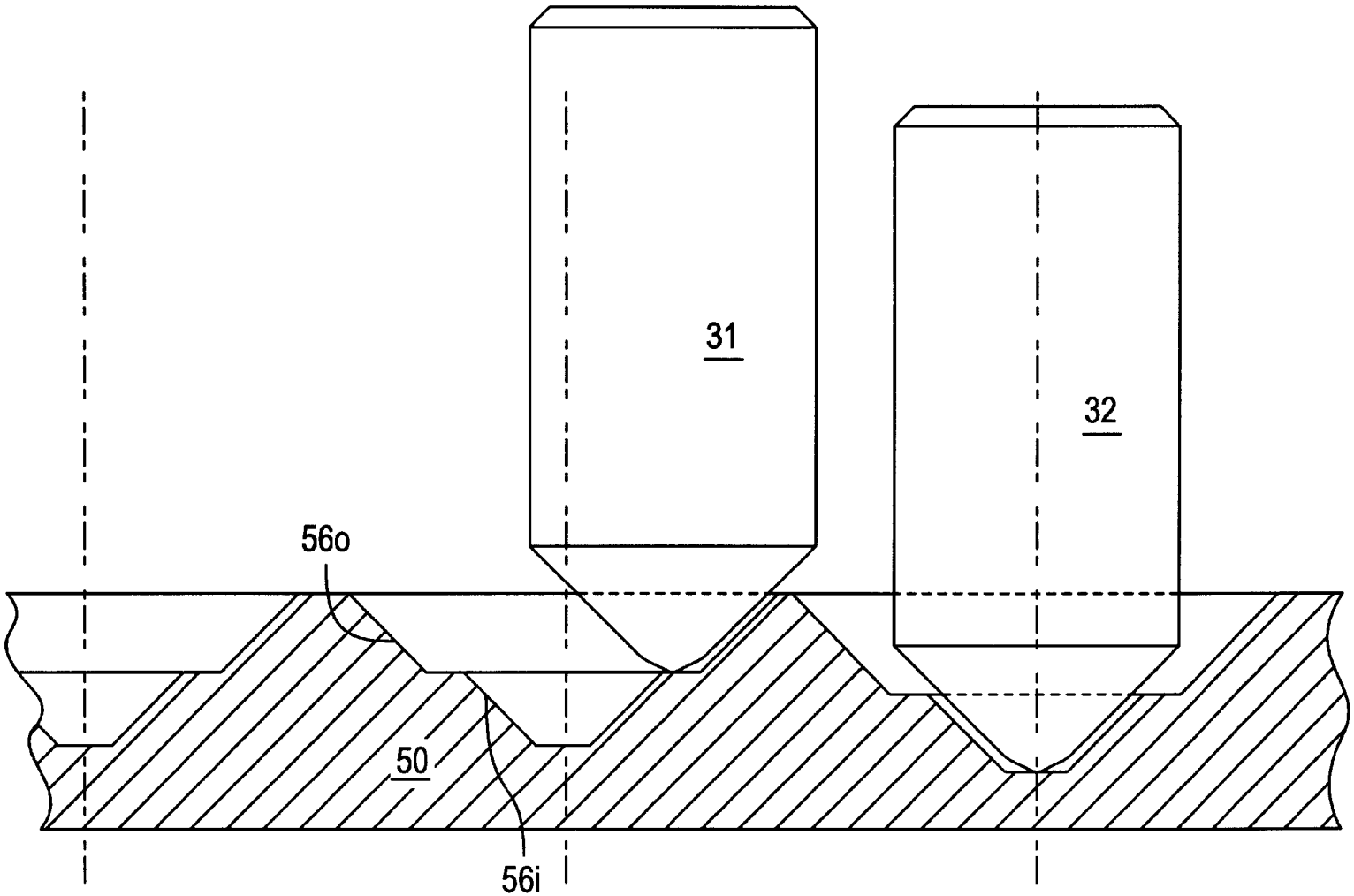
FIGS. 2(C) shows a cross-sectional view of a portion of the squiggle key in FIG. 1(A) taken along the axis 2—2 in FIG. 1(A) wherein tumbler pins of a cylinder lock are received within both upper and lower portions of the bittings.

As best seen in FIGS. 2(A) through 2(C), the bittings 56 are preferably generally circular (as viewed perpendicular to the second broad side of the key blade). The circular bittings preferably include an inner region 56*i* having a first depth and an outer region 56*o* having a second depth. The inner region 56*i* is preferably deeper than the outer region as shown. In alternative embodiments, however, one or more of the outer regions could be deeper than its respective inner region (see, e.g., 56*i*' shown in dashed lines FIG. 2(B)). The circular bittings can be easily formed with, for example, rotated drill bits. Circular bittings are thus preferred. The bittings could also have other shapes (as viewed perpendicular to the second broad side of the key blade), such as square, rectangular, etc.

As shown in FIG. 3, the cylinder lock preferably includes a row of tumbler pin bores 13 in the shell 10 and the plug preferably includes a row of tumbler pin bores 23 corresponding to the tumbler pin bores 13. Driver pins 37 are provided in the bores 13 and tumbler pins 30 (i.e., 31–35) are provided in the tumbler pin bores 13. Although five driver pins 37 and five tumbler pins 31–35 are shown in the preferred embodiments, the number of such pins can be selected as desired. In particular, one or more pins can be used, but less than three pins is much less desirable.

As shown, the driver pins 37 are maintained in position via springs 38 that are respectively held by the retainers 39 which can be screwed into the bores 13 via threads or otherwise secured thereto. The springs 38, the driver pins 37 and the tumbler pins 31–35 of the cylinder lock operate in a known manner to allow the plug 20 to rotate within the shell 10 when an appropriately bitted key 50 is inserted into the key slot 21 to elevate the tumbler pins 31–35 to their respective shear-line positions (see, for example, FIGS. 3–4).

Figure 7:
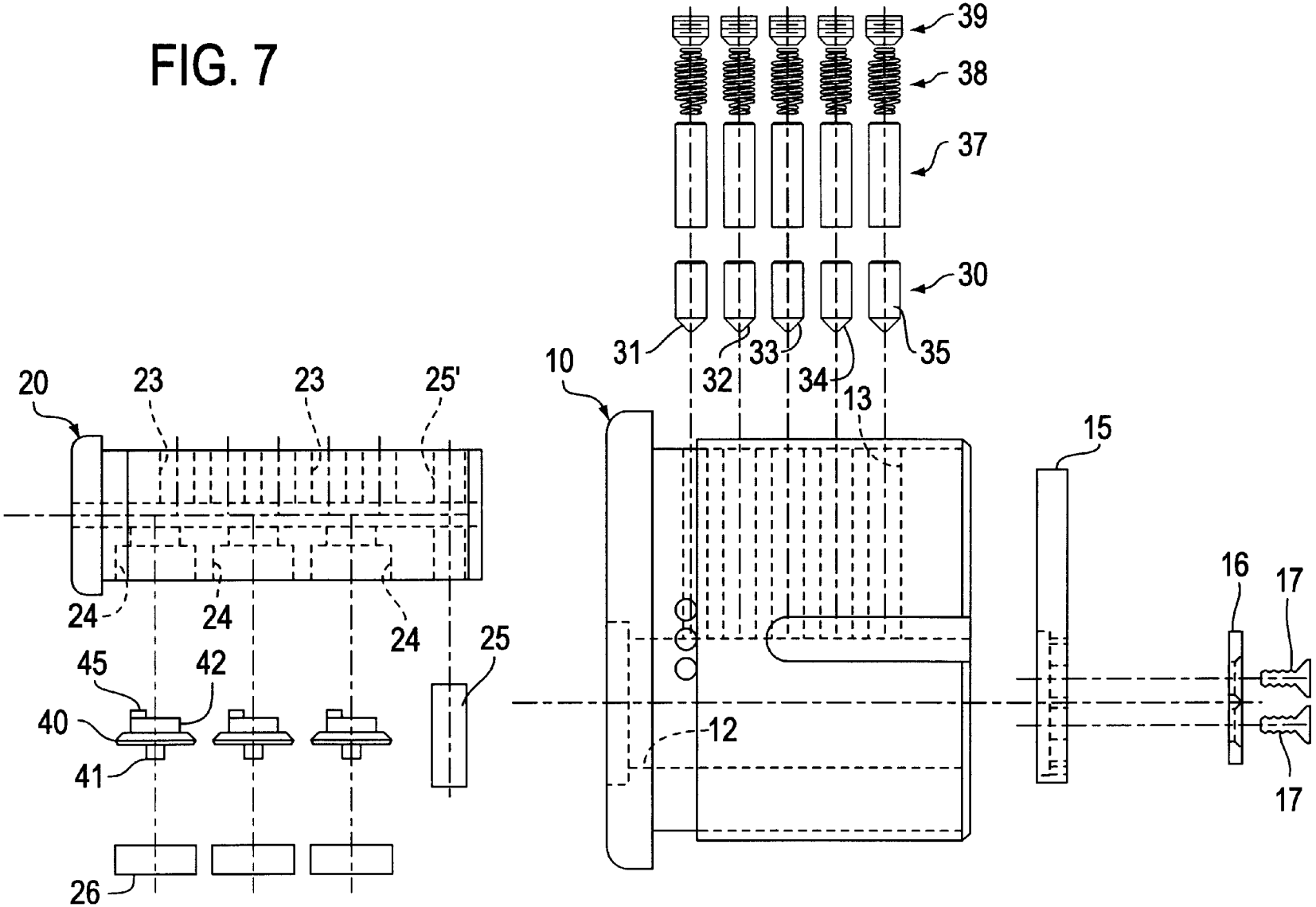
FIG. 7 is an exploded view of the cylinder lock shown in FIG. 3 showing the shell, the tumbler pins, the plug, and the rotating discs in a disassembled state.

As shown in FIG. 3, the plug 20 preferably extends rearward from the shell 10, and, as shown in FIG. 7, a tailcam 15 is preferably mounted to the rear of the plug 20 via a tailcam washer 16 and tailcam screws 17. The tailcam 15 operates in a known manner to open and close the lock when the plug 20 is rotated via a proper key.

As shown in FIGS. 2(A)–2(C), the bittings 56 preferably accommodate tumbler pins having conical tips. FIGS. 2(A)–2(C) also illustrate various potential positions of the tumbler pins within the bittings: FIG. 2(A) shows tumbler pins 31, 32 positioned within the inner region 56*i* when a key is fully inserted into a respective lock; FIG. 2(B) shows tumbler pins 31, 32 positioned within the outer region 56*o* when a key is fully inserted into a respective lock; and FIG.

2(C) shows a tumbler pin 32 positioned within the inner region 56*i* while a tumbler pin 31 is positioned within the outer region 56*o* when a key is fully inserted into a respective lock. As a result, a variety of tumbler pin positions and thus lock variations can be created.

This ability to position the tumbler pins in the inner and outer regions also enables universal keying (e.g., for a pass-all key system or for a vestibule system) wherein a plurality of different keys that operate different locks can be used to operate a common lock. For example, the inner regions 56*i* on each key can be at varied depths while the outer regions 56*o* can be at common depths. Then, a common lock to be operated by a plurality of keys can be constructed so that tumbler pins sit in the outer regions 56*o* when a key is fully inserted whereby a plurality of different keys can operate a common lock.

In order to construct such a common lock, the common lock can be modified either a) so that the tumbler pin bores in the shell 10 and the plug 20 are at different positions or b) so that the key 50 is inserted a different extent into the plug. The latter modification is preferred because the common lock can otherwise remain unchanged. As shown in FIGS. 3 and 7, the extent of insertion of the key 50 can be regulated by positioning a key-tip-stop bar 25 within a bore 25' in the rear of the plug 20. The extent of insertion of the key 50 can be altered by repositioning the bore 25' and thus the key-tip-stop bar 25. Alternatively, other forms of stop elements can be provided depending on circumstances.

In this manner, a number of different locks can be provided by merely using different length tumbler pins 31–35 and by varying the depths of the inner portions 56*i* of the bittings 56, and a single common lock can be opened by the keys of each of these different locks by merely forming the outer portions 56*o* of the bittings 56 on such keys at the same elevation on all of the keys and by varying the extent to which the keys are inserted into the common lock. For example, the key-tip-stop bar 25 can be moved a distance N (see, for example, FIG. 2(B)) toward the entrance of the key slot 21. The distance N can correspond, for example, to a distance between tumbler pin axis positions on the inner and outer regions 56*i* and 56*o*.

In a system of locks and keys, wherein a plurality of keys having the same shaped squiggle grooves 54 are provided, wherein the keys have varied bitting depths for operating individual locks of the system, and wherein a common lock is to be opened via each of the keys as discussed above, the groove 54 on the squiggle key is preferably configured to position the discs 40 in their opening positions at two insertion positions of the key 50. That is, the discs should not extend the flange portion 44 at a normal insertion position and at an insertion position of the common lock.

Figure 1D:
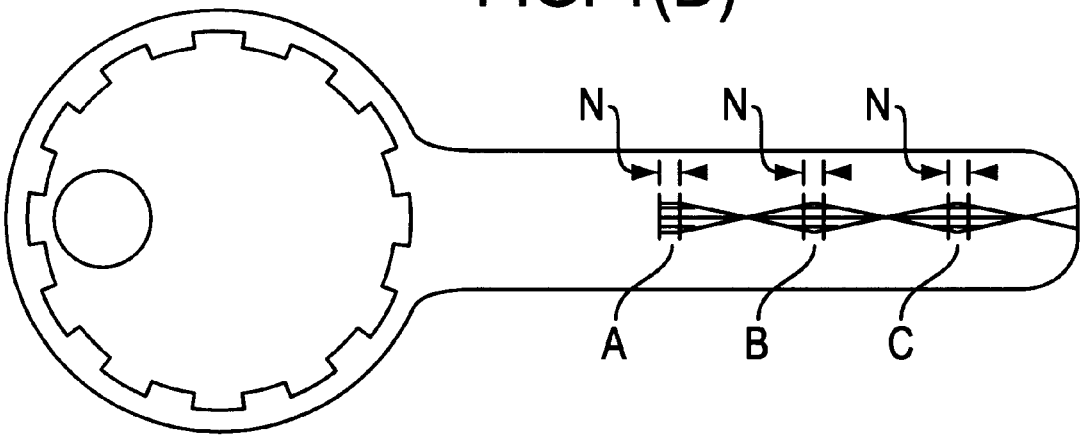
FIG. 1(D) is a schematic diagram of a key illustrating a squiggle-key groove structure having universal keying capabilities by allowing multiple positioning of the squiggle key.
Figure 1E:
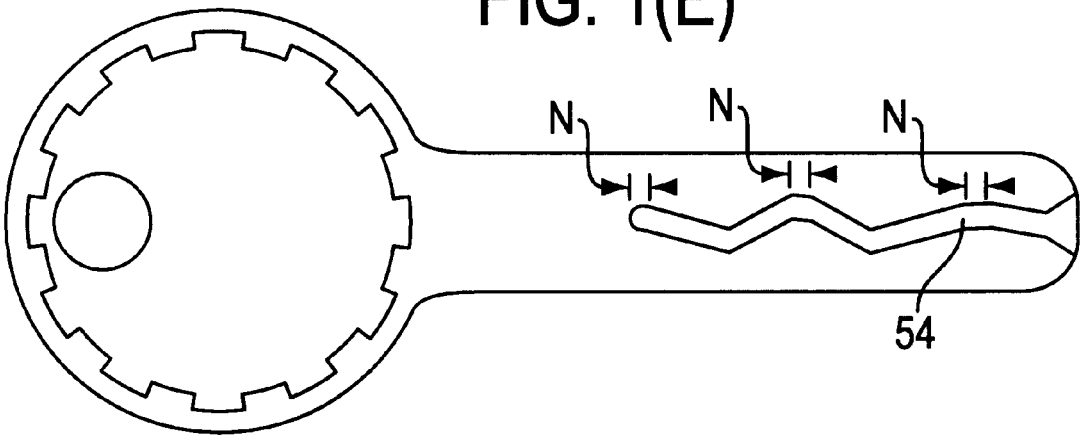
FIG. 1(E) shows an exemplary embodiment of a squiggle key with a squiggle-key groove structure having universal keying capabilities by allowing multiple positioning of the squiggle key.
Figure 1F:
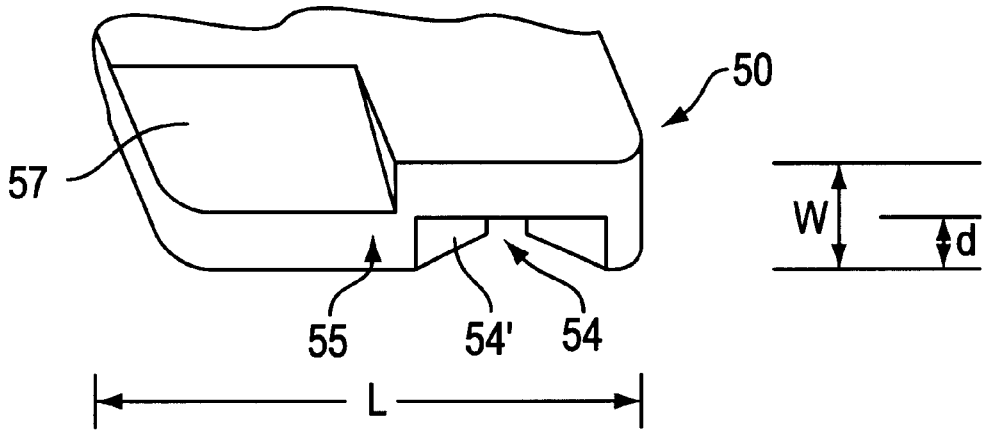
FIG. 1(F) shows a perspective end view of a squiggle key like that shown in FIG. 1(A) having a widened groove front region that facilitate insertion of groove following elements and an inclined ramp that guides the tumbler pins onto the top surface.

In this regard, as shown schematically in FIG. 1(D), the groove 54 preferably includes flat regions (such as regions A, B and C) having a length of at least N (see, e.g., FIG. 2(B)). These flat regions should be located along the key blade 52 at positions corresponding to the tumbler pin positions in the respective locks. Because the tumbler pins are preferably generally equally spaced from one another, the flat regions are also preferably at equally spaced positions as shown in FIG. 1(D). Similarly, FIG. 1(E) illustrates an exemplary groove having equally spaced flat portions having lengths of about N. Although three flat portions A, B and C are shown, the number of such flat portions will vary depending upon the number of discs within the respective locks, and, in particular, depending upon the number of discs within the common lock. In one embodiment, the flat portions are at least about 0.04 to 0.07 inches long.

Improved Ward Structure

FIG. 4 also shows another novel feature of the invention wherein the cylinder plug 20 includes two depending ward portions 27 and 28 at left and rights sides of each of the tumbler pins 31–35 as shown. The keyway 21 preferably includes a raised region 29 between the ward portions 27 and 28. The key 50 is also preferably similarly configured to include grooves at these ward portions 27 and 28 and to include a raised section corresponding to the raised region 29. The ward portions 27 and 28 preferably extend substantially along the entire keyway 21 within the plug except for the cut-out portions at the bores 23.

The left and right ward portions 27 and 28 can thus function to keep the tumbler pins 31–35 properly positioned within their respective bores 23. In view of the wider horizontal length of the key slot, without these depending ward portions, the tumbler pins 31–35 could potentially tilt slightly and thus bind or stick when abutted by an inserted key 50.

As noted, to accommodate the depending ward portions 27 and 28, the key 50 should include grooves commensurate with the positions of these ward portions. The region R, FIG. 1(A), is preferably provided in a raised section between two grooves in the key 50 as shown in FIG. 1(A), in which case the region R may still overlap with one or both of such grooves.

Improved Key Blank

According to the present invention, a novel key blank can be provided having a squiggle key groove on a first broad side of the key blank, wherein the groove includes flat portions having lengths of at least N that are preferably equidistantly spaced along the key blade.

The key blank is preferably also configured so that a second broad side thereof can receive bittings therein. In this regard, the second broad side of the key blank can be completely flat (i.e., completely blank) such as shown in FIG. 1(F). The second broad side of the key blank could also be partly machined to include one or more grooves G (see, for example, FIG. 1(A)) extending parallel to the length of the key blade 52 and/or to include a ramp 57 that facilitates positioning of tumbler pins thereon. The second broad side of the key blank can thus be completely blank or partially machined.

As noted, the key blank preferably includes a region R (see, e.g., FIG. 1(A)) that is adapted to receive the bittings 56. As discussed herein-above, the region R is preferably laterally displaced with respect to the groove 54 on the opposite side of the key 50. When the key blank is partially machined to include grooves, the key blank is preferably provided with a region R that is between two grooves in the key or that partly overlaps with one or both of such grooves.

Although less preferred, the key blank can include one or more pre-cut bittings 56 formed therein. More preferably, however, the key blank does not include any pre-cut bittings 56.

Although the preferred embodiments of the invention have been described above in detail, it is contemplated that those skilled in the art can modify the various embodiments without departing from the spirit and scope of the invention and all such modifications are included within the scope of the following claims.

What is claimed is:

1. In combination:

a) a key having a groove extending generally lengthwise along a side of said key;

b) a cylinder lock including:

a shell having a bore for receiving a rotatable plug;

a rotatable plug located within said shell and having a keyway configured to receive said key;

at least one rotatable disc within said plug, each said rotatable disc having a groove-following element that fits within said groove of said key when said key is inserted into said keyway and which rotates said rotatable disc around an axis via said key; and wherein said rotatable disc initially extends outward from a circumference of said plug and engages said shell, said rotatable disc is movable via said key so that a portion of said rotatable disc moves inward toward said plug to disengage from said shell and to allow said plug to rotate when said key is fully inserted into said keyway.

2. The combination of claim 1, wherein said groove extends along a first broad side of said key and wherein a second broad side of said key opposite to said groove includes at least one bitting for receiving a tumbler pin, and wherein said cylinder lock includes a tumbler pin bore within said plug on a side opposite to said rotatable disc, said tumbler pin bore having a tumbler pin located therein which is fittable within said bitting.

3. The combination of claim 1, wherein said groove has a depth sized to fit said groove-following element along the entire length of said groove, said groove extending along a substantial portion of a length of a key blade of said key.

4. The combination of claim 3, wherein said axis is generally perpendicular to a surface of said key blade in which said groove is formed.

5. A system of locks and keys, comprising:

a) a first squiggle key having a groove extending generally lengthwise along a first broad side of said key and having a plurality of bittings along a second broad side of said key, said plurality of said bittings including inner regions and outer regions having different depths;

b) a second squiggle key having a groove extending generally lengthwise along a first broad side of said second key and having a plurality of bittings along a second broad side of said second key, said plurality of said bittings including inner regions and outer regions having different depths;

c) said first squiggle key operating a first lock but not operating a second lock, and said second squiggle key operating a second lock but not said first lock, wherein said first and second locks include tumbler pins that align with one of said inner and outer regions on both of said first and second squiggle keys;

d) a common lock that is operated by both said first and second squiggle keys, said common lock having tumbler pins that align with the other of said inner and outer regions on both of said first and second squiggle keys.

6. A key for a cylinder lock, comprising:

a key bow;

a key blade extending from said key bow, said key blade having a narrow width and broad first side and a broad second side opposite said broad first side;

a squiggle groove extending generally lengthwise along said broad first side of said key blade; and said second broad side of said key blade having a plurality of bittings located along a common center-line generally parallel to a length of said key blade and configured to receive tumbler pins of a cylinder lock that are generally perpendicular to said second broad side.

7. The key of claim 6, wherein said plurality of bittings include bittings having inner regions of a first depth and outer regions of a second depth.

8. The key of claim 7, wherein said bittings having inner and outer regions are circular bittings.

9. The key of claim 8, wherein said inner regions are deeper or shallower than said outer regions.

10. The key of claim 6, wherein said second broad side of the key blade includes one or more grooves extending parallel to the length of the key blade.

11. The key of claim 10, wherein said second broad side of the key blade includes two said grooves and said bittings are located between said two said grooves or partly overlapping with at least one of said two grooves.

12. The key of claim 6, further including a ramp for facilitating positioning of tumbler pins onto said second broad surface of said key blade.

13. The key of claim 12, wherein said ramp is laterally displaced from an entrance into said groove.

14. The key of claim 6, wherein said squiggle groove has a bottom surface at a sufficient depth below said first broad side along the entire length of said groove to fit a groove-following element along the entire length of said groove, said groove extending along a substantial portion of a length of said key blade.

15. The key of claim 7, wherein said plurality of bittings are configured to receive tumbler pins at said inner regions at a first insertion position of said key into said lock, and are configured to receive tumbler pins at said outer regions at a second insertion position of said key into said lock.

16. A key blank, comprising:

a key bow;

a key blade extending from said key bow, said key blade having a narrow width and broad first and second opposite sides;

a squiggle groove extending generally lengthwise along said broad first side of said key blade; and said second broad side of said key blade including a region for receiving bittings therein positioned Generally perpendicular to said second broad side.

17. The key blank of claim 16, wherein said groove includes flat portions that are parallel to said key blade and that are flat at locations equidistantly spaced a predetermined distance along the key blade for cooperating with a lock having tumbler pins spaced said predetermined distance.

18. The key blank of claim 17, wherein said flat portions are at least about 0.04 to 0.07 inches long.

19. The key blank of claim 16, wherein said second broad side is completely flat and blank.

20. The key blank of claim 16, wherein said second broad side of the key blade is partly machined to include one or more grooves extending parallel to the length of the key blade.

21. The key blank of claim 20, wherein said second broad side of the key blade includes two said grooves and said region for receiving said bittings being between said two said grooves or partly overlapping with at least one of said two grooves.

22. The key blank of claim 16, further including a ramp for facilitating positioning of tumbler pins onto said second broad surface of said key blade.

23. The key blank of claim 22, wherein said ramp is laterally displaced from an entrance into said groove.

24. The key blank of claim 16, further including one or more pre-cut bittings formed in said second broad surface of said key blade.

25. The key blank of claim 16, wherein said squiggle groove has a bottom surface at a sufficient depth, in a direction of said width, below said first broad side along the entire length of said groove to fit a groove-following element along the entire length of said groove, said groove extending along a substantial portion of a length of said key blade.

26. The key blank of claim 25, wherein said depth is generally constant along a length of said groove.

* * * * *